United States Patent [19]

Bird

[11] Patent Number: 4,476,761

[45] Date of Patent: Oct. 16, 1984

[54] PAPER ROLL SPLITTER ATTACHMENT FOR FORK LIFT TRUCK

[75] Inventor: Perry L. Bird, Pasadena, Tex.

[73] Assignee: Champion International Corporation, Stamford, Conn.

[21] Appl. No.: 435,762

[22] Filed: Oct. 21, 1982

[51] Int. Cl.[3] ..... B26D 5/04; B26D 7/01

[52] U.S. Cl. ..... 83/614; 83/924; 83/928; 30/379

[58] Field of Search ..... 83/614, 924, 928, 54, 83/578; 30/379, 379.5; 414/908, 631-636; 187/9 R, 9 E

[56] References Cited

U.S. PATENT DOCUMENTS

| | | | |
|---|---|---|---|
| 1,838,011 | 12/1931 | Peter | 83/924 X |
| 2,545,417 | 3/1951 | Ulinski | 187/9 R |
| 2,752,998 | 7/1956 | Ferguson | 83/928 X |
| 3,204,501 | 9/1965 | Lane | 83/924 X |
| 3,245,302 | 4/1966 | Bayley | 83/614 |
| 3,779,121 | 12/1973 | Lagain | 83/614 |
| 4,023,650 | 5/1977 | Pleier | 187/9 R |
| 4,327,617 | 5/1982 | Budzich | 83/924 X |

*Primary Examiner*—James M. Meister

*Attorney, Agent, or Firm*—Evelyn M. Sommer; John H. Mulholland

[57] ABSTRACT

A mobile paper roll splitter device and a method for splitting a roll of paper are disclosed. A fork lift type truck is moved to a roll of paper and a horizontally disposed spline is inserted into the core of the paper. A horizontally disposed beam operatively connected to the truck is moved downwardly onto the roll of paper along a vertically disposed beam also connected to the truck. A blade, operatively mounted on the horizontal beam, is moved horizontally back and forth along the horizontal beam as the horizontal beam is forced downwardly onto the roll of paper, thus splitting the roll.

7 Claims, 8 Drawing Figures

PAPER ROLL SPLITTER ATTACHMENT FOR FORK LIFT TRUCK

BACKGROUND OF THE INVENTION

The present invention is directed to the field paper roll splitting devices, and to devices in general which function to prepare plug or beater rolls of paper for subsequent beater or other operation.

Cellulose fibers, as produced by the pulp mill, are generally unsuitable for delivery direct to a paper making machine. The raw fibers would result in an unsatisfactory sheet in terms of both physical properties and appearance. Consequently, depending on fiber characteristics and sheet use requirements, it is necessary to treat fibers to attain the qualities desired in the finished paper or paperboard.

One such treatment of the raw fibers is known as "beating", wherein relatively long, smooth, stiff fibers are transformed by mechanical means into shorter, fibrilated and more flexible fibers.

The beater is usually operated intermittently as a batch unit relatively independent of other equipment. The fibers may be furnished to the beater in slush form through a pipeline or by introducing dry sheets of pulp or broke paper directly into the beater. The term "broke" refers to a partly or completely manufactured paper or board which is not salable. Many times such paper is in the form of large rolls, hereinafter referred to as broke rolls.

The paper in the broke rolls has heretofore been prepared for use with beaters by splitting the roll of paper on a stationary "guillotine". Specifically, the broke roll is delivered to, and positioned underneath, the blade of the stationary quillotine. The blade is then forceably dropped onto the broke roll, thus splitting the roll of paper from its outermost part to its core through a radial line. The loose broke sheets are then collected and later delivered to the beater for processing.

This technique has several drawbacks. First, the above described technique is slow, since the broke rolls must first be slit, then transported to the beater for use therein. This is extremely inefficient, since many times the broke rolls will first have to be transported a significant distance to the stationary guillotine, and the split paper may subsequently have to be transported over a significant distance to the beater. Additionally, the stationary guillotine represents a significant hazard to operating personnel.

OBJECTS AND SUMMARY OF THE INVENTION

It is therefore an object of the invention to overcome the shortcomings associated with the prior techniques.

It is a further object of the invention to provide a mobile paper roll splitter which is significantly quicker, safer and more efficient to operate than the prior art devices.

It is a further object of the invention to provide a significantly quicker, safer and more efficient method of preparing broke rolls for beater operation.

In accordance with the first aspect of the invention, a paper roll splitter which is adapted to be attached to a forklift type of truck includes a vertically disposed beam, a horizontally disposed beam, a blade and a spline. The vertically disposed beam is adapted to be secured to a vertically movable part of the truck. The horizontally disposed beam is connected to the vertically disposed beam so as to allow substantially vertical movement of the horizontally disposed beam with respect to the vertically disposed beam. The blade is connected to the horizontally disposed beam so as to allow substantially horizontal movement of the blade with respect to the horizontally disposed beam. Finally, the spline is secured to the vertically disposed beam.

The device further includes means for moving the horizontally disposed beam relative to the vertically disposed beam and means for moving the blade relative to the horizontally disposed beam. Specifically, the means for moving the horizontally disposed beam may include a first carriage connected to the vertically disposed beam by a plurality of rollers, and at least one hydraulic ram attached at one end to the first carriage and at the other end to the vertically disposed beam, the horizontally disposed beam being secured to the first carriage. Preferably, two hydraulic rams are provided on opposite sides of the vertically disposed beam. The means for moving the blade relative to the horizontally disposed beam may include a second carriage connected to the horizontally disposed beam by a plurality of rollers, and a hydraulic ram attached at one end of the second carriage and at the other end to the first carriage, the blade being secured to the second carriage. Preferably, the vertically and horizontally disposed beams are comprised of I-beams, and the blade is horizontally disposed and is tapered.

In accordance with the second aspect of the invention, a process for splitting a roll of paper includes the steps of moving a fork lift type truck to the roll of paper, inserting a horizontally disposed spline which is operatively connected to the truck into the core of the paper, moving a horizontally disposed beam which is operatively connected to the truck downwardly onto the roll of paper, and moving a blade operatively mounted on the beam horizontally back and forth as the beam is moved downwardly onto the roll of paper, thus splitting the roll of paper.

The process may further include the steps of vertically moving the spline prior to the step of inserting to thus align the spline with the core of the paper, and moving the truck and the roll of paper on the spline to another location prior to splitting the roll of paper.

BRIEF DESCRIPTION OF THE DRAWINGS

These and other objects, aspects and embodiments of the invention will be described with reference to the following drawing figures of which.

DETAILED DESCRIPTION OF THE INVENTION

Figure 1:
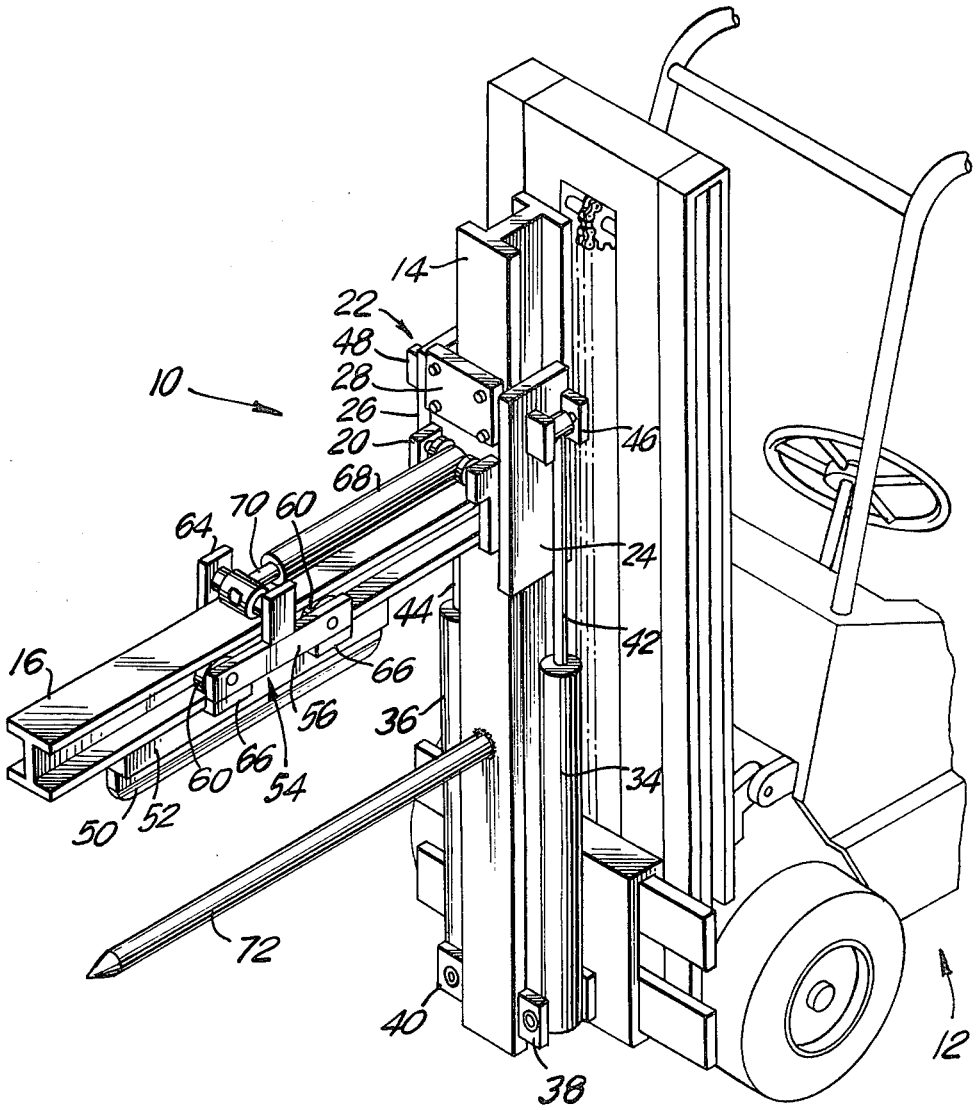
FIG. 1 is a perspective view of the paper roll splitter attachment in accordance with the present invention mounted on a forklift type truck.

The paper roll splitter attachment 10 in accordance with the present invention, mounted on a fork lift type truck 12, is illustrated in perspective in FIG. 1. The fork lift type truck 12 may be of conventional construction, and the paper roll splitter attachment 10 is conventionally mounted directly on the hoist 13 of the truck 12. The entire attachment 10 can thus be raised or lowered on the hoist 13 by the operator in a routine manner.

Figure 4:
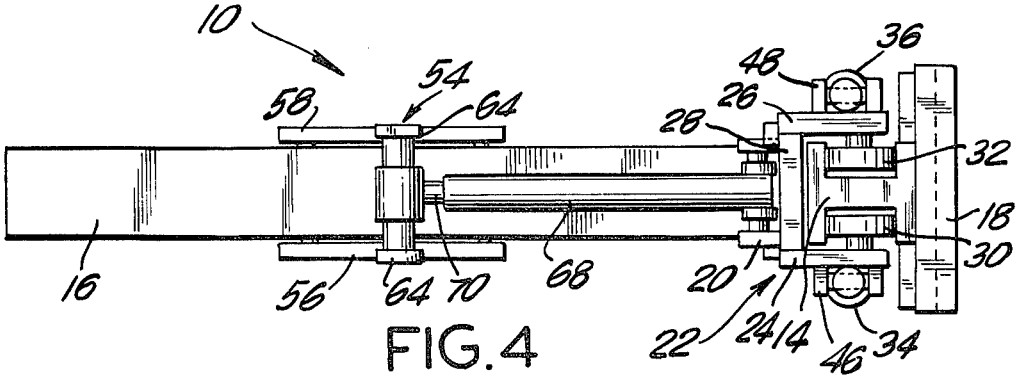
FIG. 4 is a top view of the paper roll splitter attachment in accordance with the present invention.

The details of the paper roll splitter attachment 10 will be discussed with further reference to FIGS. 2–4. The paper roll splitter attachment 10 is provided with a structural frame support comprised of a generally vertically disposed I-beam 14 and a generally horizontally disposed I-beam 16. The vertical I-beam 14 is secured to the hoist 13 of truck 12 by means of a connector bracket 18 at the bottom of the vertical I-beam 14 or by other suitable means. The horizontal I-beam 16 is connected to the vertical I-beam 14 by way of a bracket 20 and a vertical carriage 22. The horizontal I-beam 16 is fixed to the bottom of the bracket 20, which in turn is fixed to left and right side plates 24 and 26 of the vertical carriage 22. The left and right side plates 24 and 26 of the vertical carriage 22 are connected to each other at the upper portions thereof by means of a connector plate 28. The vertical carriage 22 is slidably disposed (in a vertical direction) along the vertical I-beam 14 by means of left and right roller pairs 30 and 32 connected to the top and bottom portions of the respective left and right side plates 24 and 26. As best shown in FIG. 4, the left and right roller pairs 30 and 32 are disposed within the channels of the vertical I-beam 14. Also connected to the left and right side plates 24 and 26 are respective left and right vertical hydraulic rams 34 and 36 connected at their lower portions to the bottom of the vertical I-beam 14 by respective left and right bottom brackets 38 and 40. The left and right vertical pistons 42 and 44, respectively, mounted within the left and right vertical hydraulic rams 34, and 36, are connected to the left and right side plates 24 and 26, respectively, by means of respective left and right top brackets 46 and 48. Thus, the vertical carriage 22 can be moved in an upward or downward direction by actuating the vertical hydraulic rams 34 and 36 in a routine manner. Since the horizontal I-beam 16 is fixed to the vertical carriage 22, the horizontal I-beam 16, and all apparatus associated therewith, will accordingly move with the horizontal beam 16 vertically along the vertical beam 14 with the vertical carriage 22.

Provided on the horizontal I-beam 16 is a tapered blade 50 mounted within a blade mount 52. The blade mount 52 is fixed to a horizontal carriage 54 which is slidably disposed within the channels of the horizontal I-beam 16. Specifically, the horizontal carriage 54 is comprised of left and right side plates 56 and 58, respectively, each of which is provided with respective left and right roller pairs 60 and 62 which are rotatably mounted on the respective left and right side plates 56 and 58. The left and right side plates 56 and 58 are connected by means of bracket 64 which extends over the horizontal I-beam 16, and by means of a pair of brackets 66 which are disposed underneath the horizontal I-beam 16. The blade mount 52 is fixed to the brackets 66. A single horizontal ram 68, secured at one end to the bracket 20, is provided with horizontal piston 70 which is fixed to the bracket 64. Thus, by actuating the horizontal ram 68, the horizontal carriage 54, along with the blade mount 52 and tapered blade 50, may be moved back and forth in a generally horizontal direction.

Finally, a spline 72 is fixed to the vertical I-beam 14 by welding or any other suitable technique, at a location approximately one or two feet above the bottom brackets 38 and 40.

Figure 2:
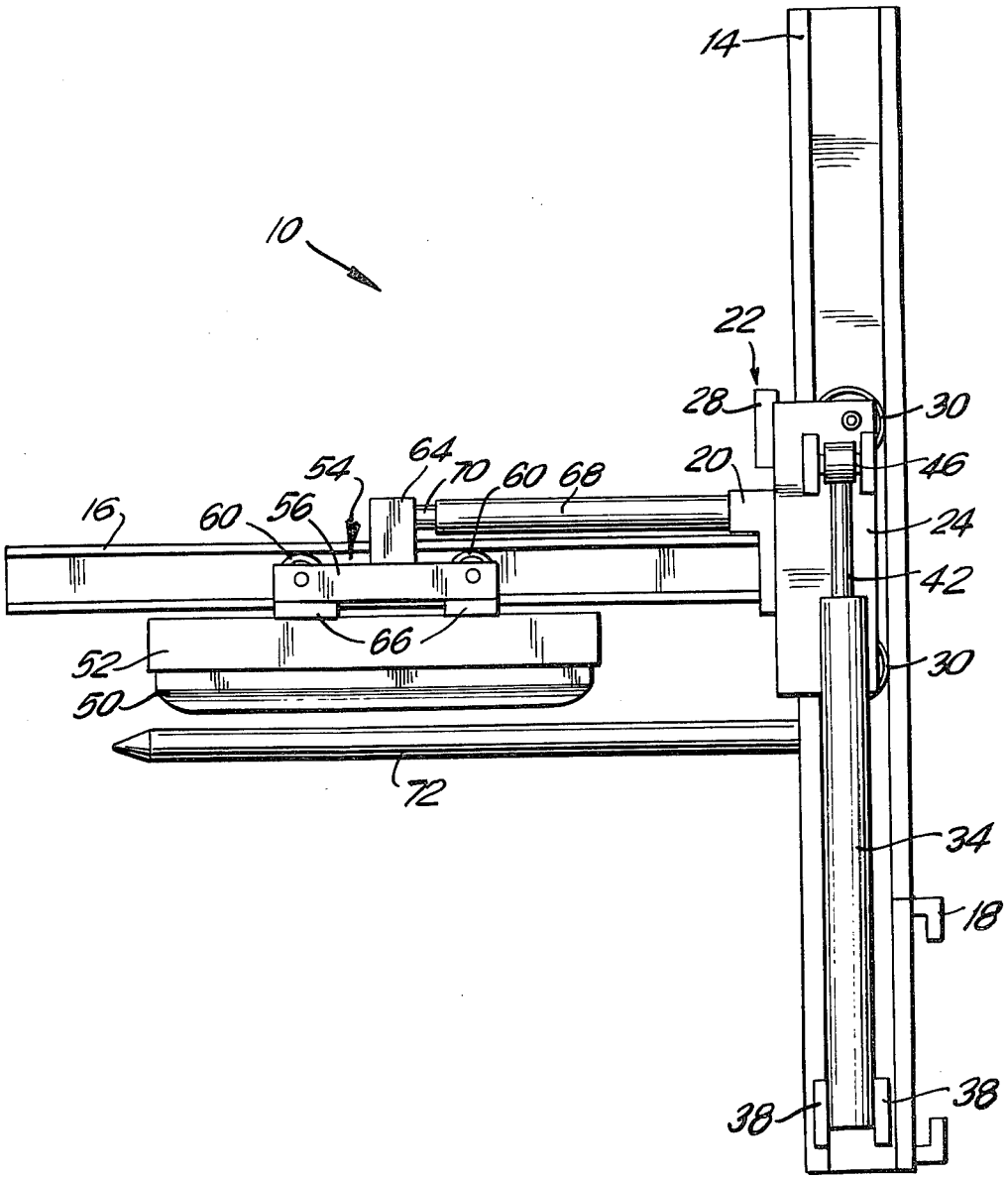
FIG. 2 is a side view of the paper roll splitter attachment in accordance with the present invention.
Figure 3:
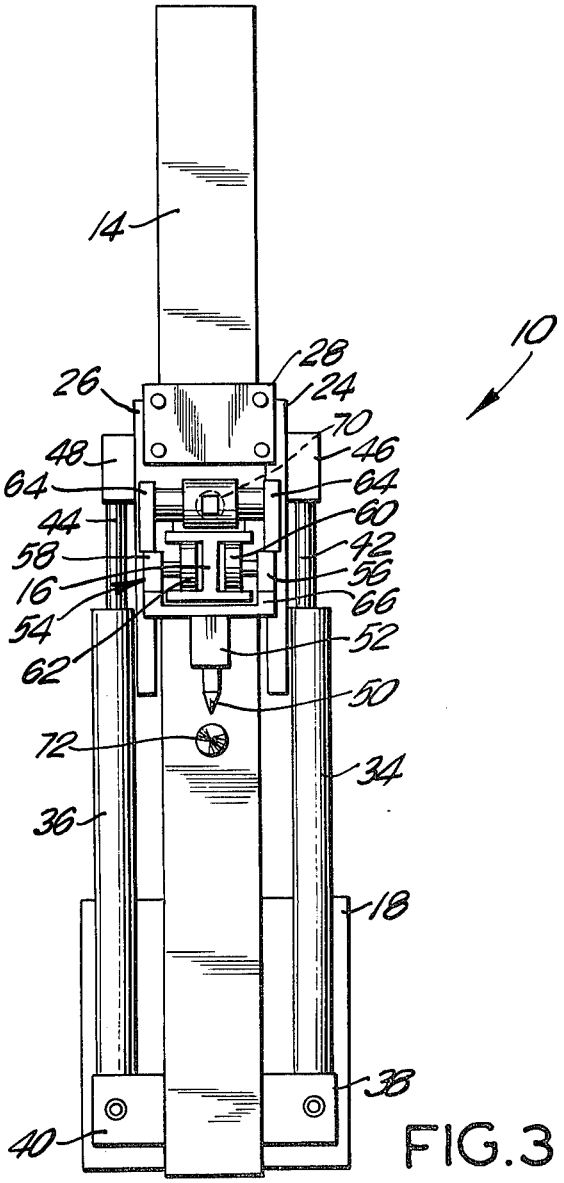
FIG. 3 is a front view of the paper roll splitter attachment in accordance with the present invention.

In operation, the entire roll splitter attachment illustrated in FIGS. 2 through 4 is adapted to be attached to the hoist 13 of a standard fork lift type truck 12 at the connector bracket 18, as with any other standard attachment. The hydraulics for the vertical and horizontal hydraulic rams 34, 36 and 68, may be connected to the usual remote control levers via "quick disconnects", or any other suitable hydraulic connection means. Since the connector bracket 18 is connected to the hoist 13, which can be vertically raised and lowered as desired, the entire paper roll splitter attachment can be moved vertically upward and downward by means of standard fork lift controls. In addition, the paper roll splitter attachment further provides vertical movement of the horizontal I-beam 16 on the vertical carriage 22 and horizontal movement of the tapered blade 50 on the horizontal carriage 54. The above-described movements may be accomplished concurrently, or one at a time, if desired.

Figure 5D:
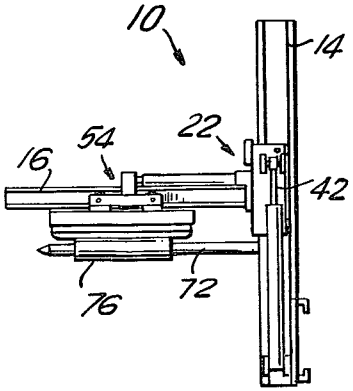
FIGS. 5A–5D illustrate the step-by-step technique for practicing the process of the present invention utilizing the paper roll splitter attachment.
Figure 5C:
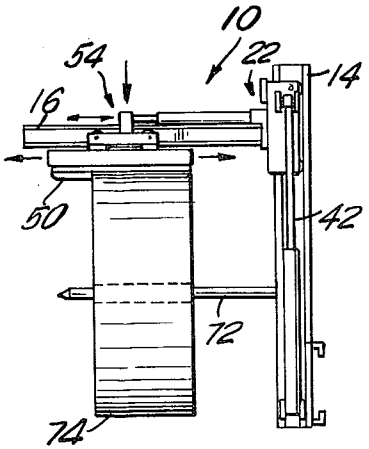
Figure 5B:
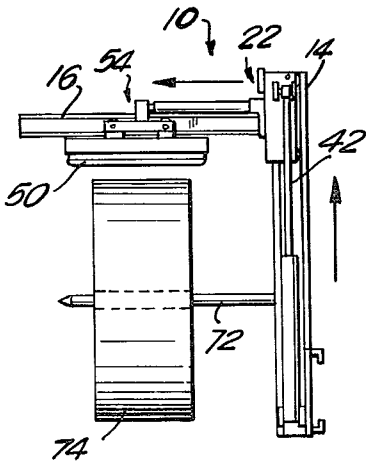
Figure 5A:
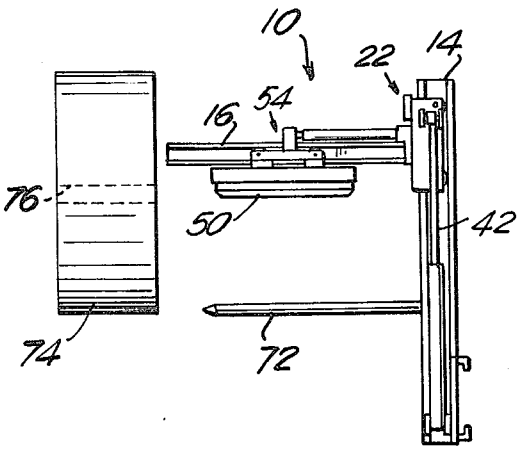

The process in accordance with the present invention will be described with reference to FIGS. 5A–5D. As shown in FIG. 5A the paper roll splitter attachment 10, mounted on the truck 12 (not shown), is moved to the location of a broke roll 74. The broke roll 74, standing on edge, can be picked up by inserting the spline 72 into the core of the roll. This is accomplished by positioning the paper roll splitter attachment 10 in front of the broke roll 74, adjusting the vertical height of the attachment 10 to place the spline 72 in alignment with the core 76, and by moving the truck forward to thus insert the spline 72 into the core 76 as illustrated in FIG. 5B. The truck may then proceed to any particular station as desired, with the broke roll 74 on the spline 72. For example, the roll 74 can be picked up in a warehouse, loading dock, etc., and delivered to the precise location of use, i.e. over a beater, belts, baler or the like. Once in the desired position, the operator can activate the hydraulic rams to force the horizontal I-beam 16 and the blade 50 in a downward direction, while at the same time forcing the carriage 54 and blade 50 back and forth in a horizontal direction as illustrated in FIG. 5C, to thereby rapidly slice through the roll of paper. After the entire roll is split, as shown in FIG. 5D, the core 76 can be removed, the horizontal I-beam 16 can be moved vertically upward, and the truck, along with the paper roll splitter attachment 10 can be moved to the next roll and the process continued.

In accordance with a specific example of the present invention, the overall length of the vertical I-beam was approximately 76 inches, and the overall length of the horizontal I-beam 16 was approximately 42 inches, thus allowing the paper roll splitter to split rolls of paper of up to about 42 inches in width and about 50 inches in diameter. The horizontal I-beam 16 and the tapered blade 50 covered a vertical distance of approximately 26 inches along the vertical I-beam 14, and the blade moved through a horizontal distance of approximately 9 inches along the horizontal I-beam 16. The blade 50 was approximately 36 inches in length and the splitting was accomplished in approximately 5 to 15 seconds, depending upon the dimensions of the roll.

The use of the mobile paper roll splitter in accordance with the present invention can significantly reduce the manpower and material requirements compared to the use of the prior art stationary quillotine arrangement. Since the rolls can be both transported and split on the same fork lift truck, the time required to cut rolls may be reduced by up to 90%. Further, the roll splitting operation in accordance with the present invention may be practiced by a single person, as opposed to the prior art technique which was at least a two man operation. Additionally, since the stationary quillotine is not required in accordance with the present invention, the present technique is much safer for employees.

Although the present invention has been described with reference to the foregoing specification and the drawings, many modifications, additions and deletions thereto may be made without departing from the scope and spirit of the present invention. For example, the tapered blade 50 may be provided with additional tapers on the front and rear ends thereof, as illustrated in dashed lines in FIG. 2, to thus facilitate the splitting of especially wide rolls. Further, although the spline 72 is described as being fixed to the vertical I-beam 14, the present invention can also be practiced through the use of a spline 72 which can be moved relative to the vertical I-beam 16, thus obviating the need for the entire attachment 10 to be moved vertically. The scope of the invention will be defined with reference to the following claims.

What is claimed is:

1. A paper roll splitter device including a supported and guided blade for attachment to a fork lift type truck, comprising:

generally vertically disposed means to vertically guide and support including means to be secured to a vertically movable part of the truck for vertical movement;

generally horizontally disposed means to horizontally guide and support connected to and vertically guided and supported by the vertically disposed means to vertically guide and support so as to allow substantially vertical movement of the horizontally disposed means to horizontally guide and support;

a blade connected to the horizontally disposed means to horizontally guide and support so as to allow substantially horizontal back and forth movement of the blade; and means for supporting a roll adjacent the blade secured to the device.

2. The device of claim 1 further comprising first means for moving the horizontally disposed means to horizontally guide and support relative to the vertically disposed means to vertically guide and support, and second means for moving the blade back and forth relative to the roll.

3. The device of claim 2 wherein the first means comprise a first carriage connected to the vertically disposed means to guide and support by a plurality of roller means and at least one hydraulic ram attached at one end to the first carriage and at the other end to the vertically disposed means to guide and support, the horizontally disposed means to guide and support being secured to the first carriage.

4. The device of claim 3 wherein two such hydraulic rams are provided on opposite sides of the said vertically disposed means to guide and support.

5. The device of claim 4 wherein the second means comprise a second carriage connected to the horizontally disposed means to guide and support by a plurality of roller means and a hydraulic ram attached at one end to the second carriage and at the other end to the first carriage, the blade being secured to the second carriage.

6. The device of claim 5 wherein said vertically and horizontally disposed means to guide and support are comprised of I-beams.

7. The device of claim 5 wherein said blade is generally horizontally disposed and is tapered.

* * * * *